United States Patent [19]

Grainger

[11] Patent Number: 4,553,615

[45] Date of Patent: Nov. 19, 1985

[54] ROTARY DRILLING BITS

[75] Inventor: Alfred J. Grainger, Longlevens, England

[73] Assignee: NL Industries, Inc., New York, N.Y.

[21] Appl. No.: 467,672

[22] Filed: Feb. 17, 1983

[30] Foreign Application Priority Data

Feb. 20, 1982 [GB] United Kingdom ..... 8205073

[51] Int. Cl.[4] ..... E21B 10/52; E21B 10/56

[52] U.S. Cl. ..... 175/329; 175/354; 175/410

[58] Field of Search ..... 175/329, 410, 330, 331, 175/354, 374, 375

[56] References Cited

U.S. PATENT DOCUMENTS

| | | | |
|---|---|---|---|
| 1,723,381 | 8/1929 | Seifert | 175/354 X |
| 1,790,613 | 1/1931 | Gildersleeve et al. | 175/354 X |
| 3,720,273 | 3/1973 | McKenry et al. | 175/354 X |
| 3,763,492 | 10/1973 | Levitt | 175/354 |
| 4,073,354 | 2/1978 | Rowley et al. | 175/329 |
| 4,200,159 | 4/1980 | Peschel et al. | 175/329 |
| 4,201,421 | 5/1980 | Den Besten et al. | 299/86 |
| 4,222,446 | 9/1980 | Vasek | 175/329 |
| 4,350,215 | 9/1982 | Radtke | 175/410 X |
| 4,396,077 | 8/1983 | Radtke | 175/411 X |

*Primary Examiner*—Stephen J. Novosad
*Assistant Examiner*—Bruce M. Kisliuk
*Attorney, Agent, or Firm*—Caesar, Rivise, Bernstein & Cohen

[57] ABSTRACT

A rotary drilling drag bit for drilling from the surface deep holes in sub-surface formations e.g. for oil has a body (4) with a diameter of at least 100 mm and having a bore for passage of drilling fluid to its face (3) and rotatable cutting elements (6) having a cutting face comprising an agglomerate of diamond particles so mounted on the body (4) that they are free to rotate in use.

The cutting elements are of long life and highly effective in drilling.

13 Claims, 6 Drawing Figures

FIG.1.
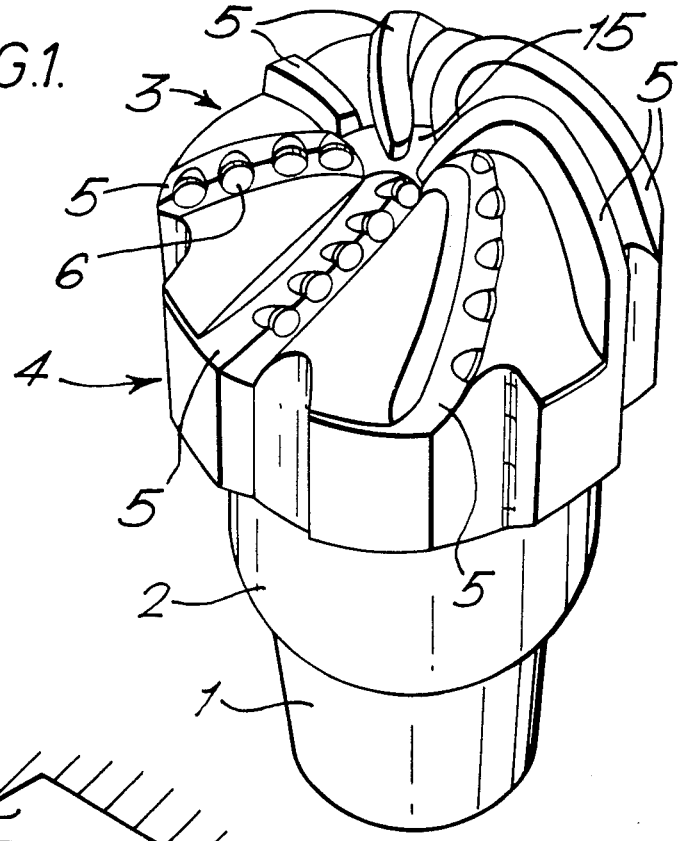
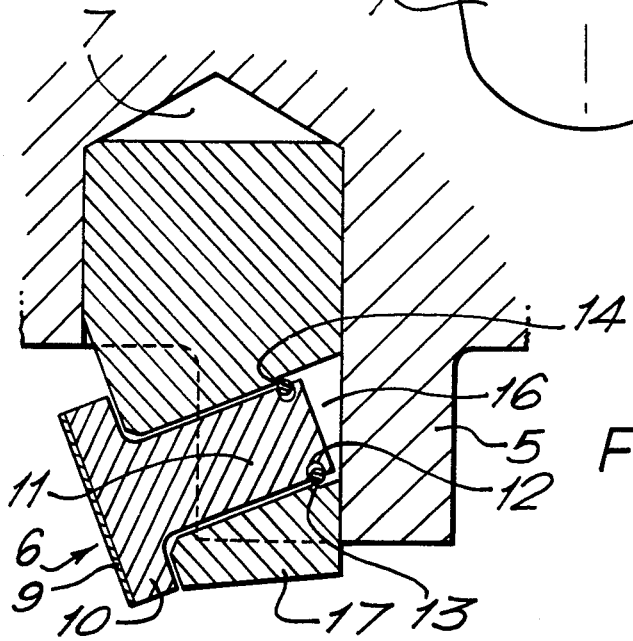
FIG.6.

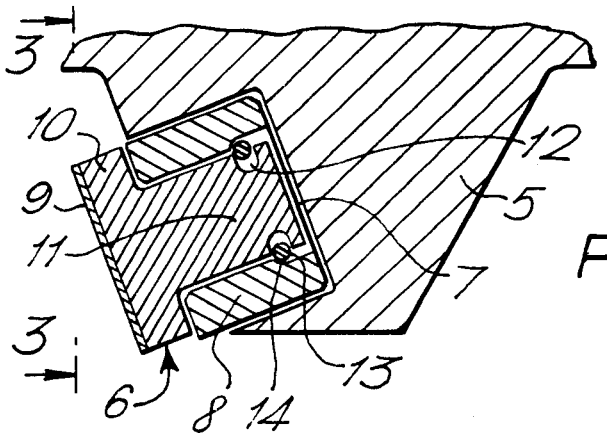
FIG. 2.
FIG. 3.
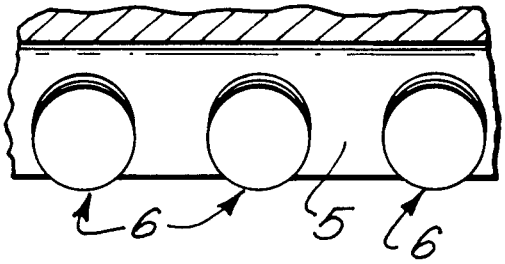
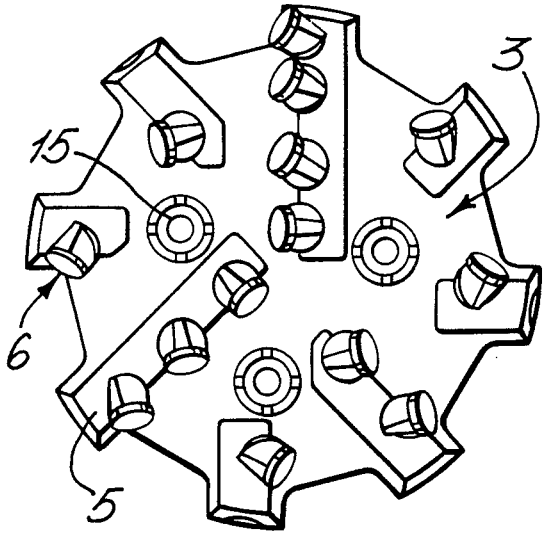
FIG. 4.

ROTARY DRILLING BITS

The invention relates to rotary drilling bits, in particular such bits for drilling or coring, from the surface, deep holes in sub-surface formations.

In U.K. patent specification No. 1239074 there is described a rotary drilling bit having disc-shaped cutters, which may be free to rotate, mounted in sockets in the bit body.

An object of the present invention is to provide a rotary drilling bit having rotary cutting elements which are of long life and highly effective in drilling.

According to the invention a rotary drilling drag bit, for drilling or coring, from the surface, deep holes in sub-surface formations e.g. for oil, gas, waste disposal or geothermal energy extraction, has a body with a shank having a bore for the passage of drilling fluid to the face of the bit, the diameter of the body exceeding 100 mm, and a plurality of rotatable cutting elements, having a cutting face comprising an agglomerate of diamond particles, so mounted on the body that they are free to rotate in use of the bit.

The fact that the cutting face of the rotatable cutting elements comprises an agglomerate of diamond particles enables substantial advantages to be achieved through the rotation of the cutting elements. In particular, the rotation gives the cutting elements a longer life and more even wear and can aid removal of cuttings. In bits generally of the type now in question rotatable cutting elements have in practice been adopted rarely if at all, the disadvantages of structures proposed in the past being perceived to outweigh any advantages. Moreover, whilst it is known to provide drilling bits having cutting elements comprising an agglomerate of diamond particles and that such elements can give a very effective cutting action, it was accepted that the cutting elements should be fixed.

The bits of the invention have a variety of advantages and a particular advantage or combination of advantages may be especially valuable in a specific situation. After a given amount of use, bits of the invention can provide higher rates of penetration than known bits. Moreover, the bits are of extended useful life. Furthermore, if longer life is not required, the number of cutting elements can be reduced, thereby reducing cost. Also, the bits of the invention permit economic drilling in harder or more abrasive formations. A further advantage is that the bits do not require the cutting face of the cutting elements to be a supremely hard layer and thus the cutting face can be of material less prone to chipping and impact damage.

The cutting elements may be mounted on the bit body in a variety of ways such that they are free to rotate but it is preferred that the cutting element should have a spindle rotatably mounted in a hole in the bit body for rotation of the cutting element. Alternatively, the cutting element may be rotatably mounted on a fixed axle protruding from the bit body.

The outer i.e. cutting part of the rotatable cutting elements is preferably a disc and it is much preferred that the diameter of the spindle of the cutting element or of the axle on which the cutting element is mounted should be at least 45% of the diameter of the disc. In this manner it is possible to obtain the advantages from the rotation of the cutting elements and yet to have rotatably mounted cutting elements that have good resistance to being broken off from the bit during use.

As already stated, the cutting face of the rotatable cutting elements comprises an agglomerate of diamond particles and the diamond particles may be natural or synthetic. In addition to the diamond particles, secondary particles and a metallic bonding agent may be present. Preferably the cutting face is a layer, which may be relatively thin, of agglomerated polycrystalline diamond and is backed by a thicker layer of cemented tungsten carbide. Where the cutting element has a spindle, this may be of cemented tungsten carbide for example or other material and is preferably integral with the backing or support layer of the cutting element. Cutting elements of the type usable in drilling bits of the invention are sometimes termed preform cutting elements.

The diameter of the body of drilling bits of the invention usually exceeds 160 mm as the bits are for deep hole drilling and for that purpose such diameters are normally required. The body of the bit may be of steel but preferably all or part of the face of the bit body is of so-called matrix material e.g. tungsten carbide particles infiltrated with a metal alloy. Preferably the body is of matrix at least in those areas where the cutting elements are mounted.

The rotatable cutting elements are preferably mounted on the bit body at a side rake: this helps to cause rotation of the cutters during use of the bit.

Drilling bits of the invention usually have at least four of the rotatable cutting elements, preferably at least nine. However, the drilling bit may also have one or more non-rotatable cutting elements: in the case of full hole bits as opposed to coring bits any cutting element near the bit axis may be fixed as cutting elements in that region are subject to far less wear than cutting elements near the gauge of the bit. The bit may have at its face a plurality of blades and the cutting elements may be mounted on the blades but the presence of blades is not essential.

The drilling fluid bore in the bit leads to one or more passageways to the face of the bit and the opening or openings of the passageway(s) at the bit face are preferably in hard material such as infiltrated tungsten carbide matrix or are provided by a nozzle or nozzles of cemented tungsten carbide or ceramic or other suitable hard material.

A method according to the invention for drilling or coring, from the surface, a deep hole in a sub-surface formation comprises securing the bit to a drill string and rotating the drill string whilst passing drilling fluid through the bore in the bit to its face, the rotation of the bit in the formation being such as to cause rotation of the rotatable cutting elements.

The drilling fluid or 'mud' is pumped through the bit, emerges at the bit face and flows upwardly past the cutting elements. The mud flushes the cuttings away and cleans and cools the cutting elements. The bit is preferably rotated at 50 to 150 revolutions per minute.

Drilling bits of the invention may be used in a variety of sub-surface formations e.g. hard rock, claystones, shales, limestone, sandstone, quartz, clays, chalk and dolomite.

The rotatable cutting elements themselves form a further aspect of the invention.

The invention is further described with reference to the accompanying diagrammatic drawings in which:

FIG. 1 is a perspective view of a drilling bit of the invention,

FIG. 2 is an enlarged section through one of the rotatable cutting elements in the bit of FIG. 1, FIG. 3 is a reduced scale part sectioned view taken along line 3—3 in FIG. 2, FIG. 4 is an end view of another drilling bit of the invention, FIG. 6 is an enlarged section through one of the rotatable cutting elements in the bit of FIG. 5.

Figure 5:
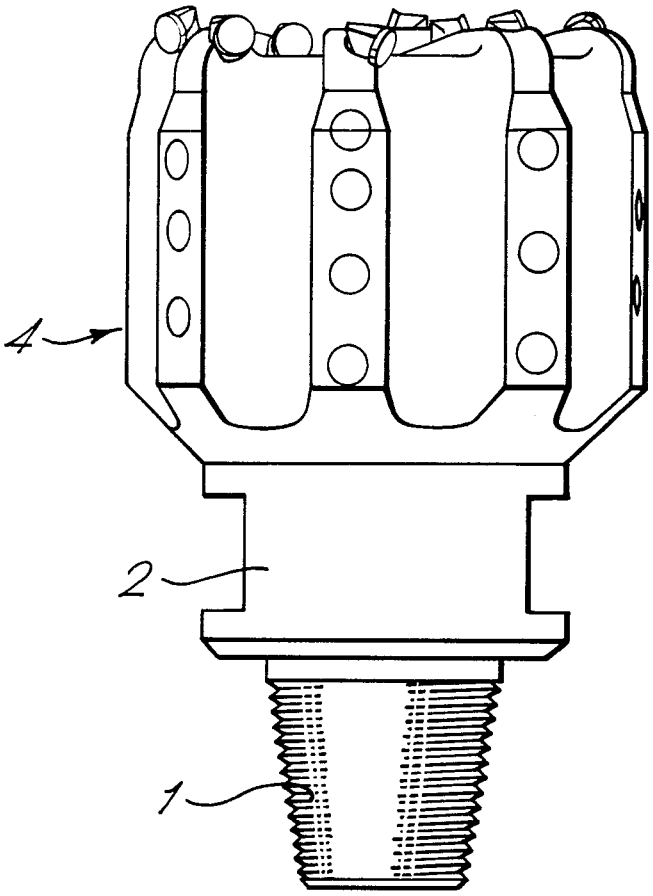
FIG. 5 is a side view of the bit of FIG. 4.

Referring to FIG. 1, the bit comprises a screwed pin connection 1 and a shank 2 in which is a bore (not shown) through which drilling fluid can be supplied through aperture 15 to face 3 of the main body portion 4 of the bit which has a diameter of about 165 mm. At its face the bit has seven blades 5 carrying cutting elements 6 (only shown for three of the blades) mounted at a side rake.

Apart from the cutting elements in the central region of the face of the bit, the cutting elements are rotatably mounted as shown in FIG. 2. For each of the rotatable cutting elements there is a hole or pocket 7 in the blade 5 and, set in the pocket, a bush 8, of cemented tungsten carbide for example.

The bush 8 may be held in place by brazing or, if the blade 5 is of matrix material, by being put in the mould during the formation of the blade, the infiltrating metal alloy binder used in that process serving to secure the bush to the adjacent matrix material. The blades 5 are preferably of matrix material or coated with a highly erosion resistant material whilst the remainder of the main body portion of the bit may be of matrix material or of steel.

The rotatable cutting element 6 (FIG. 2) has a disc-shaped cutting face in the form of a thin layer 9 of agglomerated polycrystalline diamond. The layer 9 is supported by a thicker layer 10 of cemented tungsten carbide and the layer 9 is preformed with the layer 10. The layer 10 has at its back a spindle 11 of cemented tungsten carbide integral with the layer 10.

The spindle 11 is journalled in the bush 8 and towards its inner end the spindle has a peripheral groove 12. A resilient split ring 13 is fitted in the groove before insertion of the spindle into the bush, is compressed into the groove during insertion of the spindle into the bush and, when the insertion is complete, expands to the position shown in FIG. 2, partly against internal shoulder 14 in the bush and partly still within the groove 12. In this way the cutting element is held in place under all conditions although it may be appreciated that when the bit is at the bottom of the hole being drilled the cutting element is in any event held in place by being pressed against the formation being drilled. The groove and the split ring may have a variety of cross-sections instead of those shown in FIG. 2. Other means e.g. pins or nails may be used to hold the cutting elements in place.

In the bit of FIGS. 4 and 5 the body is preferably of steel and as in the bit of FIG. 1 there is a screwed pin connection 1 and shank 2 in which is a bore (not shown) through which drilling fluid can be supplied to face 3 of the main body portion of the bit. In this case drilling fluid emerges at the bit face through three cemented carbide nozzles 15 rather than through a single central opening. At its face the bit has a number of blades 5 each carrying one or more cutting elements 6 mounted at a side rake.

Apart from the cutting elements in the central region of the face of the bit, the cutting elements are rotatably mounted as shown in FIG. 6. The cutting elements themselves are generally similar to those of the bit of FIG. 1 but rather than being journalled in a bush they are journalled in a bore 16 in a stud or peg 17 secured in a pocket 7 in the blade 5. The cutting elements may be held in place by the same means as in the bit of FIG. 1. The stud or peg 17 is preferably of cemented tungsten carbide but steel might be used.

In the bits the thrust and journal bearing surfaces of the bush or stud and of the cutting element are accurately dimensioned and of low surface roughness in order to facilitate rotation of the cutting elements and without undue wear of the bearing surfaces. If desired the bit may include means for supplying lubricant to the bearing surfaces and/or for inhibiting the ingress of debris between the bearing surfaces. To enhance the behaviour of the bearings the bore of the bush may be provided with a sleeve of a low friction material or coated with such a material and the spindle may be coated with such a material and a washer of low friction material may be mounted on the spindle between the inner face of the disc and the outer face of the bush or either or both of these faces may be coated with low friction material.

In use of a drilling bit of the invention the contact with the formation causes the rotatable cutting elements to rotate and thus all of the cutting edge is used for the cutting action. Accordingly, the wear on the cutting edge of each of the rotatable cutting elements is more uniform than would otherwise be the case and thus not only do the cutting elements have a longer useful life but also a longer period of drilling with sharp cutting elements can be achieved.

I claim:

1. A rotary drilling bit, for drilling, from the surface, deep holes in sub-surface formations, comprising a bit body with a face and a shank having a bore for the passage of drilling fluid to the face of the bit, the diameter of the body of the bit exceeding 100 mm, and a plurality of rotatable cutting elements, each of said cutting elements being in the form of a disc having a cutting face comprising an agglomerate of diamond particles in the form of a thin flat layer, bonded to a thicker backing layer of cemented tungsten carbide, each disc having a cylindrical spindle extending from the backing layer and rotatably mounted in a hole in an element set in the body of the bit, the axis of rotation of the spindle extending perpendicularly to the cutting face of the cutting element, said spindle, in a direction away from the cutting face, being inclined rearwardly with respect to the direction of rotation of the bit and in a direction away from the surface of the formation being cut by said cutting element, said cutting elements being free to rotate in use of the bit.

2. A bit according to claim 1 in which the agglomerate is an agglomerate of diamond particles, secondary particles and a metallic bonding agent.

3. A bit according to claim 1 in which the diameter of the spindle is at least 45% of the diameter of the disc.

4. A bit according to claim 1 in which the element set in the body of the bit is a bush formed of cemented tungsten carbide.

5. A bit according to claim 4 in which there is a sleeve of low friction material in the bore of the bush.

6. A bit according to claim 4 in which the spindle is coated with a low friction material.

7. A bit according to claim 4 in which the inner face of the disc is coated with low friction material.

8. A bit according to claim 4 in which the outer face of the bush is coated with low friction material.

9. A bit according to claim 1 in which the element set in the body of the bit is in the form of a peg.

10. A bit according to claim 9 in which the peg is of cemented tungsten carbide.

11. A bit according to claim 9 is which the peg is of steel.

12. A bit according to claim 1 in which the cutting elements are mounted on the bit body at a side rake.

13. A bit according to claim 1 in which the diameter of the bit body exceeds 160 mm.

* * * * *